United States Patent [19]

Bellinger

[11] Patent Number: 4,457,768

[45] Date of Patent: Jul. 3, 1984

[54] CONTROL OF A REFRIGERATION PROCESS

[75] Inventor: Robert M. Bellinger, Maracaibo, Venezuela

[73] Assignee: Phillips Petroleum Company, Bartlesville, Okla.

[21] Appl. No.: 449,281

[22] Filed: Dec. 13, 1982

[51] Int. Cl.[3] ..... F25B 1/00

[52] U.S. Cl. ..... 62/21; 62/37; 62/172

[58] Field of Search ..... 62/21, 37, 132, 172, 62/115, 215, 226, 227, 228, 229, 498, 501, 510

[56] References Cited

U.S. PATENT DOCUMENTS 3,383,881 5/1968 Bailey ..... 62/45

3,527,059 9/1970 Rust et al. ..... 62/115

3,589,140 6/1971 Osborne ..... 62/197

*Primary Examiner*—Frank Sever

[57] ABSTRACT

The liquid level in at least one flash economizer associated with a refrigeration process is maintained at a desired level by controlling the flow of the liquid leaving the flash economizer in response to a control signal which is responsive to the difference between the actual liquid level in the flash economizer in the desired liquid level. The liquid level in the chiller associated with a refrigeration process is maintained by controlling the flow of fluid to the flash economizer in response to a control signal which is responsive to the difference between the actual liquid level in the chiller and the desired liquid level.

20 Claims, 1 Drawing Figure

CONTROL OF A REFRIGERATION PROCESS

Figure 1:
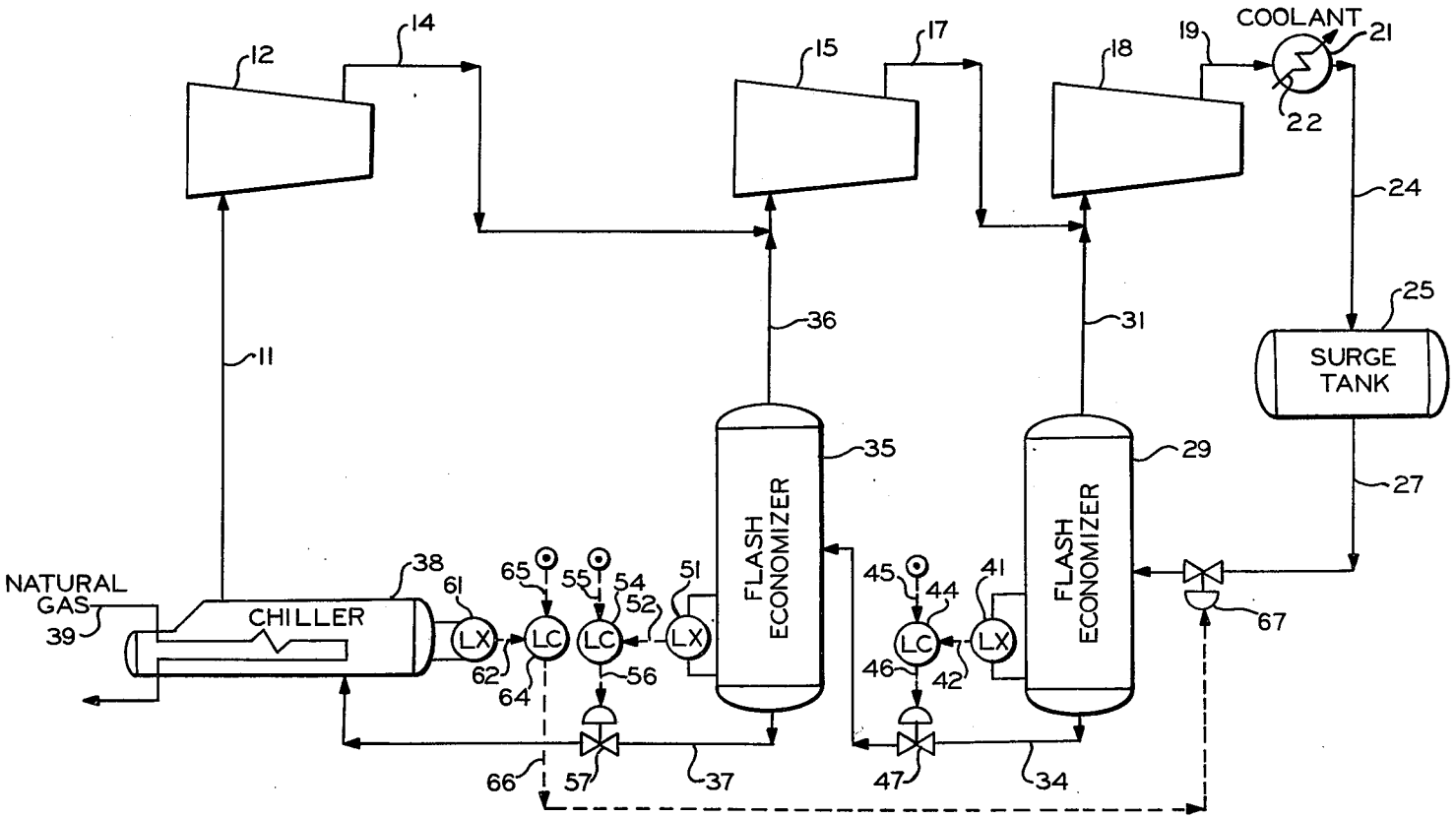

This invention relates to control of a refrigeration process. In one aspect, this invention relates to controlling a refrigeration process which employs at least one flash economizer in such a manner that stable control of the liquid level in the flash economizer is maintained.

In a typical refrigeration process used in a plant to cool a process stream such as a natural gas stream, a refrigerant such as propane is compressed and then condensed to a liquid. The thus condensed liquid is provided to a surge tank and is then passed from the surge tank through at least one flash economizer to a chiller. The refrigerant is passed in heat exchange with the process stream in the chiller and is then recycled to the compression system.

In the past, it has been common to control the liquid level in the flash economizer and the chiller by manipulating the flow of the refrigerant flowing directly to the flash economizer or chiller, respectively. However, an instability may result from such control as the flash economizers are made smaller in an effort to reduce the cost of the refrigeration system. The liquid level control on the chiller may force the liquid level in the flash economizer to vary from substantially empty to tripping a high level shutdown. This problem can of course be solved by increasing the residence time for the flash economizers but this results in an increase in the required size for the surge tank which again increases system cost and also increases the potential hazard from hydrocarbon liquids being accumulated in the process area. It is thus an object of this invention to control a refrigeration process in such a manner that the liquid level in a flash economizer employed in the refrigeration process is maintained substantially at a desired level.

In accordance with the present invention, method and apparatus is provided whereby the liquid level in a flash economizer is maintained by controlling the flow of the liquid leaving the flash economizer in response to a control signal which is responsive to the difference between the actual liquid level in the flash economizer and the desired liquid level. Liquid level in the chiller is maintained by controlling the flow of liquid to the flash economizer in response to a control signal which is responsive to the difference between the actual liquid level in the chiller and the desired liquid level. Essentially, this is a reversal of previous techniques for controlling the liquid level in a refrigeration process and it has been found that a much more stable control of the liquid level in the flash economizer is achieved as will be discussed more fully hereinafter.

Other objects and advantages of the invention will be apparent from the foregoing brief description of the invention and the claims as well as the detailed description of the drawing which is briefly described as follows:

FIG. 1 is a diagrammatic illustration of a refrigeration process and the associated control system of the present invention for maintaining desired liquid levels in a flash economizer and chiller.

The invention is described in terms of a specific refrigeration process which is employed in a natural gas liquids extraction plant to chill natural gas. However, the invention is applicable to any refrigeration process in which flash economizers are employed between the surge tank and the chiller.

Also, the invention is described in terms of a three-stage compression system and a two-stage flash economizer system. Two compression stages could be utilized or more than three stages could be utilized if desired. Also, only one flash economizer could be utilized or more than two flash economizers could be utilized.

The invention is described in terms of the use as propane as the refrigerant and using water as the coolant of the compressed refrigerant. However, other suitable refrigerants could be utilized and other fluids could be utilized to cool the compressed refrigerant.

Referring now to FIG. 1, propane in a gaseous form flows through conduit means 11 to the suction inlet of a first stage compressor 12. Propane which has been compressed with respect to the propane flowing through conduit means 11 is provided from the discharge outlet of the first stage compressor 12 through conduit means 14 to the suction inlet of the second stage compressor 15. In like manner, propane which has been compressed with respect to the propane flowing through conduit means 14 is provided from the discharge outlet of the second stage compressor 15 through conduit means 17 to the suction inlet of the third stage compressor 18. Propane which is compressed with respect to the propane flowing through conduit means 17 is provided from the discharge outlet of the third stage compressor 18 through conduit means 19 to the heat exchanger 21.

The heat exchanger 21 is provided with a cooling fluid (in the present case water) through conduit means 22. The propane flowing through conduit means 19 is condensed in the heat exchanger 21 and flows through conduit means 24 to the surge tank 25.

Liquid propane in the surge tank 25 is provided through conduit means 27 to the flash economizer 29.

The flash economizer 29 is utilized to remove impurities which are lighter than the propane refrigerant. At least a portion of the impurities will be removed as a gas from an upper portion of the flash economizer 29 through conduit means 31 and will be provided to conduit means 17 for recycle to the suction inlet of the third stage compressor 18. Fluid in the flash economizer 29 is removed through conduit means 34 and is provided to the flash economizer 35 which serves the same function as the flash economizer 29.

More of the light impurities will be removed as a gas from the flash economizer 35 through conduit means 36 and will be provided to conduit means 14 for recycle to the suction inlet of a second stage compressor 15. Liquid in the flash economizer 35 is withdrawn through conduit means 37 and is provided to the chiller 38. Vapor from the chiller 38 is provided through conduit means 11 to the suction inlet of the first stage compressor 12.

A natural gas stream is provided through conduit means 39 to the chiller 38. A natural gas flowing through conduit means 39 is passed in heat exchange with the propane refrigerant in the chiller 38 and is chilled as is required for the natural gas liquids extraction process.

The refrigeration process described to this point is a typical refrigeration process used to cool a natural gas stream. Additional equipment such as pumps, additional heat exchangers, additional control components, etc. which would typically be associated with a refrigeration process have not been illustrated since these additional components play no part in the description of the present invention.

The liquid level transducer 41 is operably connected to the flash economizer 29 so as to be able to determine the liquid level in the flash economizer 29. The liquid level transducer 41 may be any conventional transducer which operates on principals such as differential pressure or travel time of sound in a liquid. The liquid level transducer 41 establishes an output signal 42 which is representative of the actual liquid level in the flash economizer 29. Signal 42 is provided from the liquid level transducer 41 as the process variable input to the liquid level controller 44.

The liquid level controller 44 is also provided with a set point signal 45 which is representative of the desired liquid level in the flash economizer 29. In response to signals 42 and 45, the liquid level controller 44 provides an output signal 46 which is responsive to the difference between signals 42 and 45. Signal 46 is scaled so as to be representative of the position of the control valve 47, which is operably located in conduit means 34, required to maintain the actual liquid level in the flash economizer 29, represented by signal 42, substantially equal to the desired liquid level represented by signal 45. Signal 46 is provided from the liquid level controller 44 to the control valve 47 and the control valve 47 is manipulated in response thereto.

The liquid level transducer 51 is operably connected to the flash economizer 35 so as to be able to determine the liquid level in the flash economizer 35. The liquid level transducer 51 establishes an output signal 52 which is representative of the actual liquid level in the flash economizer 35. Signal 52 is provided from the liquid level transducer 51 as the process variable input to the liquid level controller 54.

The liquid level controller 54 is also provided with a set point signal 55 which is representative of the desired liquid level in the flash economizer 35. In response to signals 52 and 55, the liquid level controller 54 provides an output signal 56 which is responsive to the difference between signals 52 and 55. Signal 56 is scaled so as to be representative of the position of the control valve 57, which is operably located in conduit means 37, required to maintain the actual liquid level in the flash economizer 35, represented by signal 52, substantially equal to the desired liquid level represented by signal 55. Signal 56 is provided from the liquid level controller 54 to the control valve 57 and the control valve 57 is manipulated in response thereto.

The liquid level transducer 61 is operably connected to the chiller 38 so as to be able to determine the liquid level in the chiller 38. The liquid level transducer 61 establishes an output signal 62 which is representative of the actual liquid level in the chiller 38. Signal 62 is provided from the liquid level transducer 61 as the process variable input to the liquid level controller 64.

The liquid level controller 64 is also provided with a set point signal 65 which is representative of the desired liquid level in the chiller 38. In response to signals 62 and 65, the liquid level controller 64 provides an output signal 66 which is responsive to the difference between signals 62 and 65. Signal 66 is scaled so as to be representative of the position of the control valve 67, which is operably located in conduit means 27, required to maintain the actual liquid level in the chiller 38, represented by signal 62, substantially equal to the desired liquid level represented by signal 65. Signal 66 is provided from the liquid level controller 64 to the control valve 67 and the control valve 67 is manipulated in response thereto.

As was previously stated in the introductory portions of this disclosure, in the past it would have been common for signal 66 to manipulate control valve 57, signal 56 to manipulate control valve 47 and signal 46 to manipulate control valve 67, i.e. all level control was based on controlling the flow of liquid directly to a vessel. However, this control could result in draining of the flash economizers since a demand for liquid by the chiller 38 could drain liquid from the flash economizers before control valves 67 and 47 could be opened to supply liquid.

The present invention avoids this problem by ensuring that a demand for a liquid by the chiller 38 is satisfied by first supplying liquid to the flash economizers. In this manner, the possibility of draining the flash economizers is substantially eliminated and a much more stable control of the liquid level in the flash economizers can be maintained while also maintaining a desired liquid level in the chiller 38.

The invention has been described in terms of a preferred embodiment as illustrated in FIG. 1. The process equipment utilized is well known to those familiar with refrigeration processes. Specific control components which can be used in the practice of the invention as illustrated in FIG. 1 such as level transducers 41, 51 and 61; level transducers 44, 54 and 64 and control valves 47, 57 and 67 are each well known, commercially available control components such as are described at length in Perry's Chemical Engineers Handbook, 4th Edition, Chapter 22, McGraw-Hill.

While the invention has been described in terms of the presently preferred embodiment, reasonable variations and modifications are possible by those skilled in the art and such modifications and variations are within the scope of the described invention and the appended claims.

That which is claimed is:

1. Apparatus comprising:

a compression system;

means for providing a refrigerant gas to the suction inlet of said compression system;

cooling means;

a surge tank;

means for passing compressed refrigerant from the discharge outlet of said compression system through said cooling means to said surge tank, wherein said compressed refrigerant is at least partially condensed in said cooling means;

a first flash economizer;

means for providing liquid refrigerant from said surge tank to said first flash economizer;

a chiller;

means for providing liquid refrigerant from said first flash economizer to said chiller;

means for passing a process stream to be cooled in heat exchange with the liquid refrigerant contained in said chiller;

means for establishing a first signal representative of the actual liquid level in said chiller;

means for establishing a second signal representative of the desired liquid level in said chiller;

means for comparing said first signal and said second signal and for establishing a third signal which is responsive to the difference between said first signal and said second signal;

means for manipulating the flow rate of liquid refrigerant to said first flash economizer in response to said third signal;

means for establishing a fourth signal representative of the actual liquid level in said first flash economizer;

means for establishing a fifth signal representative of the desired liquid level in said first flash economizer;

means for comparing said fourth signal and said fifth signal and for establishing a sixth signal which is responsive to the difference between said fourth signal and said fifth signal; and means for manipulating the flow rate of liquid refrigerant from said first flash economizer to said chiller in response to said sixth signal.

2. Apparatus in accordance with claim 1 additionally comprising a first control valve operably located so as to control the flow of liquid refrigerant from said surge tank to said first flash economizer, wherein said third signal is scaled so as to be representative of the position of said first control valve required to maintain a desired liquid level in said chiller and wherein said means for manipulating the flow of liquid refrigerant from said surge tank to said first flash economizer in response to said third signal comprises means for manipulating said first control valve in response to said third signal.

3. Apparatus in accordance with claim 2 additionally comprising a second control valve operably located so as to control the flow of liquid refrigerant from said first flash economizer to said chiller, wherein said sixth signal is scaled so as to be representative of the position of said second control valve required to maintain a desired liquid level in said first flash economizer and wherein said means for manipulating the flow of liquid refrigerant from said first flash economizer to said chiller in response to said sixth signal comprises means for manipulating said second control valve in response to said sixth signal.

4. Apparatus in accordance with claim 1 wherein said means for providing liquid rerigerant from said first flash economizer to said chiller comprises:

a second flash economizer;

means for providing liquid refrigerant from said first flash economizer to said second flash economizer; and means for providing liquid refrigerant from said second flash economizer to said chiller.

5. Apparatus in accordance with claim 4 additionally comprising:

means for establishing a seventh signal representative of the actual liquid level in said second flash economizer;

means for establishing an eighth signal representative of the desired liquid level in said second flash economizer;

means for comparing said seventh signal and said eighth signal and for establishing a ninth signal which is responsive to the difference between said seventh signal and said eighth signal; and means for manipulating the flow of liquid refrigerant from said second flash economizer to said chiller in response to said ninth signal.

6. Apparatus in accordance with claim 5 additionally comprising a first control valve operably located so as to control the flow of liquid refrigerant from said surge tank to said first flash economizer, wherein said third signal is scaled so as to be representative of the position of said first control valve required to maintain a desired liquid level in said chiller and wherein said means for manipulating the flow of liquid refrigerant from said surge tank to said first flash economizer in response to said third signal comprises means for manipulating said first control valve in response to said third signal.

7. Apparatus in accordance with claim 6 additionally comprising a second control valve operably located so as to control the flow of liquid refrigerant from said first flash economizer to said second flash economizer, wherein said sixth signal is scaled so as to be representative of the position of said second control valve required to maintain a desired liquid level in said first flash economizer and wherein said means for manipulating the flow of liquid refrigerant from said first flash economizer to said chiller in response to said sixth signal comprises means for manipulating said second control valve in response to said sixth signal.

8. Apparatus in accordance with claim 7 additionally comprising a third control valve operably located so as to control the flow of liquid refrigerant from said second flash economizer to said chiller, wherein said ninth signal is scaled so as to be representative of the position of said third control valve required to maintain a desired liquid level in said second flash economizer and wherein said means for manipulating the flow of liquid refrigerant from said second flash economizer to said chiller in response to said ninth signal comprises means for manipulating said third control valve in response to said ninth signal.

9. Apparatus in accordance with claim 8 wherein vapor from said first and second flash economizers and said chiller is recycled to said compression system.

10. Apparatus in accordance with claim 1 wherein the process fluid passed in heat exchange with said refrigerant in said chiller is natural gas.

11. A method for manipulating liquid levels in a first flash economizer and a chiller associated with a refrigeration system, wherein a refrigerant gas is compressed and at least partially condensed with the compressed, at least partially condensed refrigerant being provided to a surge tank, wherein liquid refrigerant in said surge tank is provided to said first flash economizer, wherein liquid refrigerant in said first flash economizer is provided to said chiller and wherein a process stream to be cooled is passed in heat exchange with the liquid refrigerant contained in said chiller, said method comprising the steps of:

establishing a first signal representative of the actual liquid level in said chiller;

establishing a second signal representative of the desired liquid level in said chiller;

using computing means to compare said first signal and said second signal and to establish a third signal which is responsive to the difference between said first signal and said second signal;

manipulating the flow rate of liquid refrigerant to said first flash economizer in response to said third signal;

establishing a fourth signal representative of the actual liquid level in said first flash economizer;

establishing a fifth signal representative of the desired liquid level in said first flash economizer;

using computing means to compare said fourth signal and said fifth signal and to establish a sixth signal which is responsive to the difference between said fourth signal and said fifth signal; and manipulating the flow rate of liquid refrigerant from said first flash economizer to said chiller in response to said sixth signal.

12. A method in accordance with claim 11 wherein said third signal is scaled so as to be representative of the position of a first control valve, operably located so as to control the flow of liquid refrigerant from said surge tank to said first flash economizer, required to maintain a desired liquid level in said chiller and wherein said step of manipulating the flow of liquid refrigerant from said surge tank to said first flash economizer in response to said third signal comprises manipulating said first control valve in response to said third signal.

13. A method in accordance with claim 12 wherein said sixth signal is scaled so as to be representative of the position of a second control valve, operably located so as to control the flow of liquid refrigerant from said first flash economizer to said chiller, required to maintain a desired liquid level in said first flash economizer and wherein said step of manipulating the flow of liquid refrigerant from said first flash economizer to said chiller in response to said sixth signal comprises manipulating said second control valve in response to said sixth signal.

14. A method in accordance with claim 11 wherein liquid refrigerant from said first flash economizer is provided to said chiller by providing liquid refrigerant from said first flash economizer to a second flash economizer and providing liquid refrigerant from said second flash economizer to said chiller.

15. A method in accordance with claim 14 additionally comprising the steps of:

establishing a seventh signal representative of the actual liquid level in said second flash economizer;

establishing an eighth signal representative of the desired liquid level in said second flash economizer;

using computing means to compare said seventh signal and said eighth signal and to establish a ninth signal which is responsive to the difference between said seventh signal and said eighth signal; and manipulating the flow rate of liquid refrigerant from said second flash economizer to said chiller in response to said ninth signal.

16. A method in accordance with claim 15 wherein said third signal is scaled as so to be representative of the position of a first control valve, operably located so as to control the flow of liquid refrigerant from said surge tank to said first flash economizer, required to maintain a desired liquid level in said chiller and wherein said step of manipulating the flow of liquid refrigerant from said surge tank to said first flash economizer in response to said third signal comprises manipulating said first control valve in response to said third signal.

17. A method in accordance with claim 16 wherein said sixth signal is scaled so as to be representative of the position of a second control valve, operably located so as to control the flow of liquid refrigerant from said first flash economizer to said second flash economizer, required to maintain a desired liquid level in said first flash economizer and wherein said step of manipulating the flow of liquid refrigerant from said first flash economizer to said chiller in response to said sixth signal comprises manipulating said second control valve in response to said sixth signal.

18. A method in accordance with claim 17 wherein said ninth signal is scaled so as to be representative of the position of a third control valve, operably located so as to control the flow of liquid refrigerant from said second flash economizer to said chiller, required to maintain a desired liquid level in said second flash economizer and wherein said step of manipulating the flow of liquid refrigerant from said second flash economizer to said chiller in response to said ninth signal comprises manipulating said third control valve in response to said ninth signal.

19. A method in accordance with claim 18 wherein vapor from said first and second flash economizers and said chiller is recycled to said compression system.

20. A method in accordance with claim 11 wherein the process fluid passed in heat exchange with said refrigerant in said chiller is natural gas.

* * * * *